United States Patent [19]

Henrich

[11] 4,164,331

[45] Aug. 14, 1979

[54] SLIDE GUIDE DEVICE FOR MOVING WIRE AND THE LIKE

[75] Inventor: Werner Henrich, Hörbach, Fed. Rep. of Germany

[73] Assignee: Firma Henrich KG, Hörbach, Fed. Rep. of Germany

[21] Appl. No.: 764,843

[22] Filed: Feb. 2, 1977

[30] Foreign Application Priority Data

Feb. 3, 1976 [DE] Fed. Rep. of Germany ..... 2604012

[51] Int. Cl.[2] ..... B65H 54/02; B65H 57/04

[52] U.S. Cl. ..... 242/25 R; 57/71; 242/47; 242/82; 242/157 R

[58] Field of Search ..... 242/25 R, 18 R, 47, 242/54 R, 82, 83, 157 R, 53, 2, 3, 7.21; 57/68, 70, 71

[56] References Cited

U.S. PATENT DOCUMENTS

| | | | |
|---|---|---|---|
| 590,828 | 9/1897 | Dawes | 57/71 |
| 2,995,003 | 8/1961 | Geen | 57/71 |
| 3,667,092 | 6/1972 | Engels | 242/47 |
| 4,050,640 | 9/1977 | Henrich | 242/25 R |
| 4,050,641 | 9/1977 | Henrich | 242/47 |

FOREIGN PATENT DOCUMENTS

| | | | |
|---|---|---|---|
| 695531 | 8/1953 | United Kingdom | 242/53 |

*Primary Examiner*—Stanley N. Gilreath
*Attorney, Agent, or Firm*—Edmund M. Jaskiewicz

[57] ABSTRACT

A device for guiding and/or changing the direction of movement of a wire and the like moving at a high speed in a rotating structure into which the wire is introduced at the axis of rotation of the rotating structure comprises a slide guide spaced from the axis of rotation of the rotating structure. The slide guide is provided with a contact path upon which the wire moves and air under pressure or a lubricant may be introduced to the path to reduce the friction between the path and the moving wire.

14 Claims, 8 Drawing Figures

SLIDE GUIDE DEVICE FOR MOVING WIRE AND THE LIKE

The present invention relates to a device for guiding and changing the direction of movement of wire and the like moving at a high speed in a rotating structure, more particularly, to such a device upon which the moving wire slides along a contact path.

Various forms of apparatus have been employed for the winding of wire and the like elongated materials including but not limited to cables, stranded wires, ropes and tapes. One such winding device comprises a rotating structure in the form of a flyer which guides the moving wire upon a spool. The flyer is provided with guide pulleys journalled therein to receive the wire generally entering at the axis of rotation of the flyer and guiding the wire so as to be wound uniformly upon a spool. Since the wire moves over the guide rollers at a high speed the rollers and their bearings are subjected to extremely high stresses and are subjected to centrifugal forces of sufficient magnitude to throw the lubricant from the bearings. As result, the bearings are inadequately lubricated and their operating life is significantly decreased. Further, it becomes impossible to obtain a continuous economical winding operation.

The speed of winding can be increased by various structures known in the art such as providing improved lubrication systems, especially designed packings or seals for the bearings or even utilizing high-load bearings. However, these proposals have the disadvantage that they do limit the maximum winding speed.

It is therefore the principal object of the present invention to provide a novel and improved device for guiding and/or changing the direction of movement of a wire moving at a high speed in a rotating structure.

It is another object of the present invention to provide such a guide device which is not limited by the centrifugal forces occurring in the rotating structure and is not subjected to the limitations introduced with respect to the rotary speed of the rotating structure.

It is a further object of the present invention to provide such a guide device which can be employed over a wide range of winding speeds such that the speed of the winding operation is not limited.

According to one aspect of the present invention a device for guiding and/or changing the direction of movement of a wire and the like moving at a high speed in a rotating structure may comprise means on the rotating structure for introducing a moving wire into the rotating structure along the axis of rotation thereof. Spaced from the axis of rotation of the rotating structure is a guide means for slidingly supporting the wire moving within the rotating structure.

Since in such a winding apparatus the wire is generally supplied to the rotating structure along the axis of rotation of the rotating structure, several slide guide devices according to the present invention may be provided so as to direct the wire to move adjacent the periphery of the rotating structure and then to direct the wire toward the core of the spool so that the wire can be wound upon the core. As the rotating structure rotates, this structure or the spool may be simultaneously reciprocated along the axis of rotation of the flyer and the wire will be uniformly wound in layers upon the spool.

An advantage of the present invention is that when the flyer rotates at a high speed, the wire guided upon the slide guides is subjected to a lifting from the guides as result of centrifugal forces. This lifting reduces the contact pressure of the wire upon the slide guides. Thus, the centrifugal forces which are disadvantageous in the prior art structures are advantageous in the slide guide according to the present invention. The likelihood of breaking of the wire even when the wire is extremely fine is very slight with the slide guide of the present invention.

Other objects and advantages of the present invention will be apparent upon reference to the accompanying description when taken in conjunction with the following drawings, which are merely examplary, wherein.

Proceeding next to the drawings wherein like reference symbols indicate the same parts throughout the various views a specific embodiment and modifications of the present invention will be described in detail.

Figure 1:
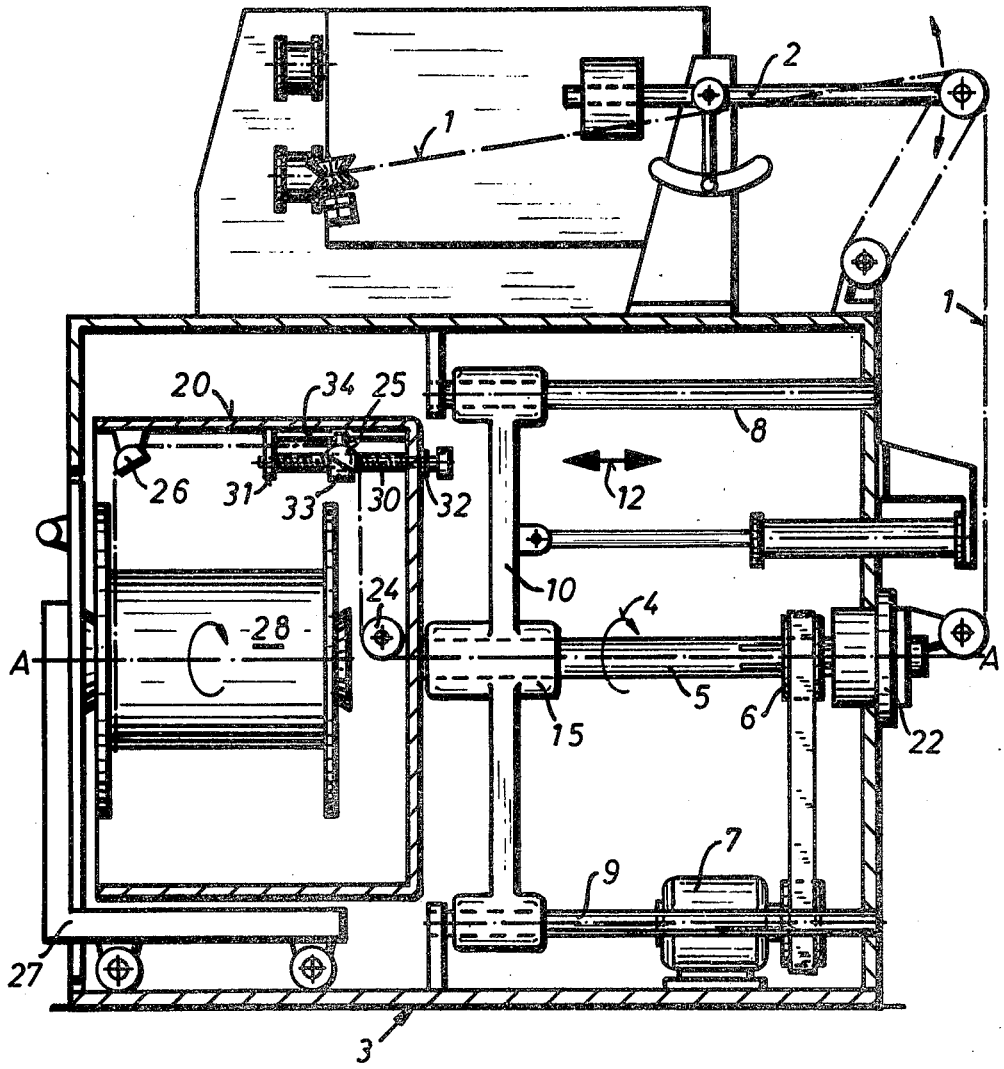
FIG. 1 is an elevational view with portions thereof in section of a wire winding apparatus having a rotating flyer provided with the slide guides according to the present invention.

As may be seen in FIG. 1, a wire 1 is supplied by a wire drawing machine which is not illustrated but is known in the art and is delivered over a tension compensator 2 to a wire winding apparatus indicated generally at 3. The wire winding apparatus may be of the type which is described in greater detail in the pending applications Ser. No. 608,001 filed Aug. 26, 1975 now U.S. Pat. No. 4,050,640 issued Sept. 27, 1977 and Ser. No. 610,408 filed Sept. 4, 1975 now U.S. Pat. No. 4,050,641 issued Sept. 27, 1977, by the assignee of the subject application.

As may be further seen in FIG. 1, the wire winding apparatus 3 essentially comprises a central hollow shaft 5 which is rotatable in the direction of an arrow 4 and driven by a motor 7 through a belt drive to a pulley 6 which is non-rotatably but slidably positioned upon the shaft 5. The shaft 5 is journaled in a hub 15 carried by a sliding carriage or frame 10 which is mounted for sliding movement on the guide rods 8 and 9 attached to the frame of the wire winding apparatus. The carriage 10 is thus reciprocable in the directions of the double-ended arrow 12 and is connected to a fluid drive motor by means of a piston rod as known in the art. The hub 15 essentially comprises a bearing block which enables the shaft 5 to rotate therein and at the same time that the shaft 5 and carriage 10 are being reciprocated.

The spline connection of the pulley 6 upon the right end of shaft 5 which is correspondingly splined enables the pulley 6 to drive the shaft while the pulley remains stationary during axial displacement of the shaft. The shaft 5 is also journaled in a bearing block 22 through which the shaft 5 can slide in an axial direction.

The shaft 5 can be driven by other arrangements including a mounting of the drive motor 7 and belt pulley 6 so that these elements are axially displaceable together with the shaft 5.

The wire 1 is introduced through the hollow shaft 5 into a flyer 20 which is cup-shaped so as to have a open end and a closed end which is attached to the shaft 5 so that the flyer is rotatable with the shaft.

Mounted in the interior of the flyer 20 is a pulley 24 around which the wire is passed radially outwardly around slide guides 25 and 26 which are attached to the outer or cylindrical wall of the flyer 20. The slide guide 26 directs the wire radially inwardly toward a core of a spool 28 which is mounted upon a moveable carriage or frame 27 for positioning into and out of the wire winding apparatus.

Upon rotation of the shaft 5 and the flyer 20, the wire will be wound upon the spool 28. A relative axial displacement is provided between the spool 28 and the flyer 20 by reciprocation of the flyer 20 together with the carriage 10 and shaft 5 in order to uniformly wind the wire 1 in layers upon the spool. This relative displacement can also be achieved by mounting the flyer for rotation only and the spool is reciprocated axially.

According to the embodiment as shown in FIG. 1, the guide around which the wire entering the flyer is first passed comprises a pulley or roller 24 but this guide can also comprise a slide guide according to the present invention such as the guides 25 and 26.

The slide guide 25 is mounted for displacement along a line parallel with the axis of rotation A—A of the flyer 20. The guide 25 is mounted upon a threaded nut 33 which in turn is mounted upon a spindle or threaded shaft 30 journaled in bearings 31 and 32. The nut 33 has a projecting portion engagable with a guide element 34 so as to prevent pivoting of the slide guide 25 when it is axially displaced upon the spindle 30.

The slide guide 25 may also be mounted for progressive or step-wise displacement as opposed to the continuous displacement obtained with the spindle mount as described above. The slide guide 25 could be moved continuously or stepwise during the winding operation by a suitable drive means which may be connected to rotate the threaded shaft 30.

Figure 8:
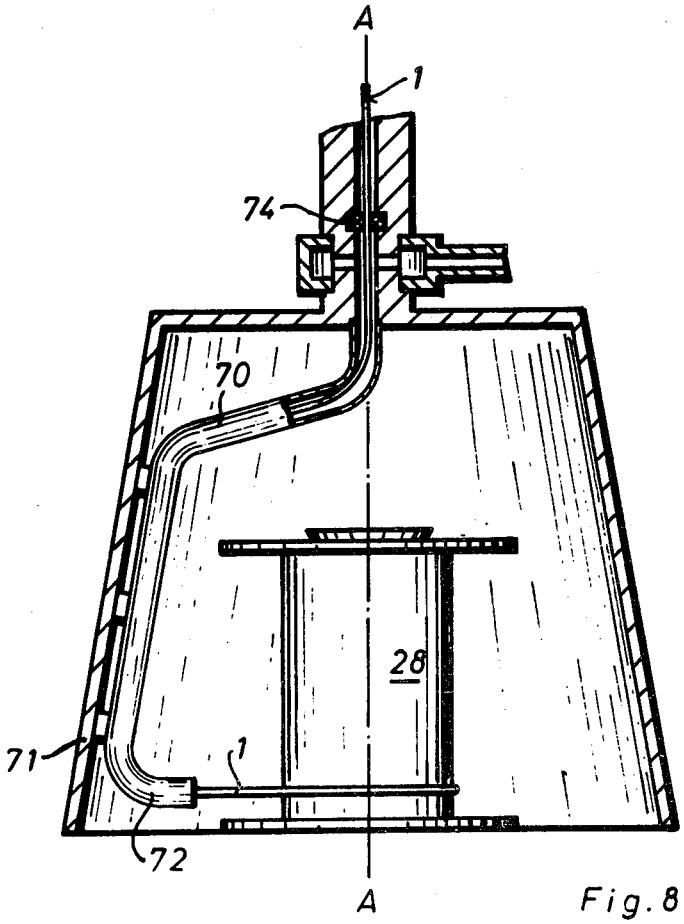
FIG. 8 is a longitudinal sectional view of a flyer on a wire winding apparatus incorporating still a further modification of the guide device of the present invention.

The flyer 20 in the present embodiment is substantially cylindrical but in a modification wherein the flyer may be conical somewhat as illustrated in FIG. 8, the slide guide 25 may be mounted for displacement along a generatrix of the conical flyer.

Figure 2:
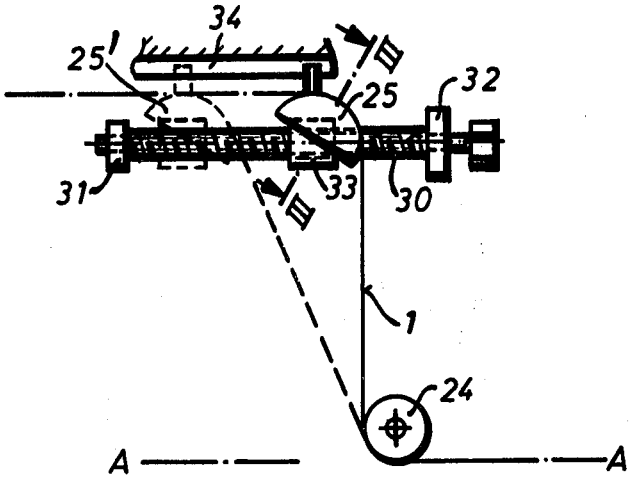
FIG. 2 is an elevational view to a larger scale of a portion of the apparatus of FIG. 1 illustrating the slide guide of the present invention.

The slide guide 25 which is axially displaceable as shown in FIG. 2 is provided with an arcuate contact path for the wire 1. This contact path is a portion of a circle such that when the guide 25 is in the position as shown in the solid lines in FIG. 2 the arc of contact is about 90°. The arc of contact decreases as the slide guide 25 is displaced to a position 25' as also shown in FIG. 2. The optimum position of the slide guide and accordingly the adjusting of the optimum arc of contact may be determined according to operating conditions as known in the art. It is to be noted that as the arc of contact is decreased on slide guide 25, the contact angle will be similarly decreased on the pulley or guide 24.

The adjustibility of this arc of contact is dependent upon the nature of the material being wound upon the spool and the speed with which the strand is being moved within the flyer to be wound upon the spool. When wires of particular materials are moved at a high speed over sliding engagement with a surface considerable heat will be generated and the wire will be susceptible to some damage. In order to avoid such damage, particularly at high winding speeds, the arc of contact is decreased in the manner as illustrated in FIG. 2. In addition, reducing the arc of contact in this manner decreases the amount of wire moving along its entire path within the flyer prior to being wound upon the spool. Reducing of the entire path of travel in this manner is particularly desireable when the spool has a considerably shorter length than the spool 28 illustrated in FIG. 1.

It is pointed out that the slide guide 25 need not be displaceable so as to be adjustable axially as shown in FIG. 2. The guide 25 can be fixed in particular position which is appropriate for the particular winding speed at which the winding apparatus is to be operated and in accordance with the nature of the wire or other elongated material which is to be wound.

Figure 3:
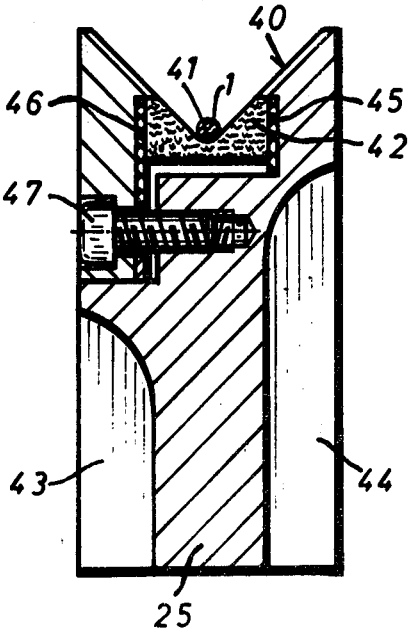
FIG. 3 is a sectional view taken along the line III-III of FIG. 2 and in enlarged scale.

As may be seen in FIG. 3, the slide guide 25 has on its upper end a V-shaped groove 40 comprising two sides or flanks extending angularly from a rounded bottom portion 41 located at the center of the groove so that wire 1 which is moving along the rounded portion 41 essentially forms a linear contact with the groove 40. The angle of the groove 40 may be varied such as to be later described in connection with FIG. 6.

The lower portion of the groove 40 is formed by a slide guide element 42 which is formed of a ceramic material highly resistant to wear such as electro-corundum ($Al_2O_3$) also used in wire-drawing guides. In order to keep the weight of the slide guide to a minimum, the runner 42 is secured in a frame or support of a low-density material such as a light metal, preferably aluminum, or even a suitable synthetic resin. The frame or support is further provided with cut-out portions or recesses 43 and 44 in order to reduce further the mass of the slide guide. Thus, the mass of the entire rotating structure is maintained as low as possible in order to minimize centrifugal forces.

The runner 42 is secured between elastic elements 45 and 46 secured between components of the frame and attached by means of a screw 47. The elastic elements 45, 46 compensate for the differential thermal expansion of the several materials during the operation of the slide guide and also prevents stressing of the guide from the friction heat appearing in the area of wire contact.

The relatively wide angle of the groove 40 results in a linear contact between the wire 1 and rounded bottom 41 which in turn reduces friction forces during movement of the wire over the slide guide and further minimizes the possibility of jamming of the wire.

As the wire 1 is introduced through shaft 5 into the flyer 20 the wire is supplied to the spool 28 by means of the guide pulley 24 and slide guides 25 and 26 so that the wire is wound in layers on the core of the spool during the reciprocation and simultaneous rotation of the flyer. The higher the speed of rotation of the flyer 20 and accordingly the slide guides 25 and 26, the greater would be the tendency of the wire 1 to lift itself from the guides 25 and 26 so that the contact pressure of the wire upon these guides is reduced. As a result, the load or forces acting upon the wire through the guides is significantly reduced or even removed.

However, it is to be noted that relieving the wire of the load produced by centrifugal forces does not occur when the rotation of the flyer is being slowed down by braking on completion of the winding operation or where the flyer is accelerating at the start of a winding operation. Considerable stressing of the wire may occur during the periods of operation of the flyer at reduced rotary speed. Such stressing of the wire can be kept at a minimum by a suitable axial positioning of the slide guide so as to obtain the optimum angle of the arc of contact of the wire on the runner such as disclosed in FIG. 2.

Figure 4:
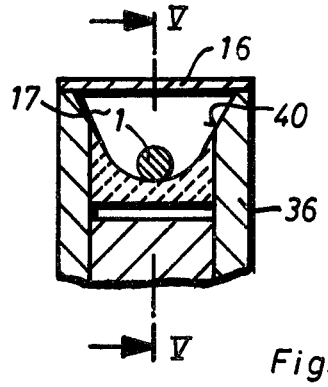
FIG. 4 is a view similar to a portion of FIG. 3 but showing a modification thereof.
Figure 5:
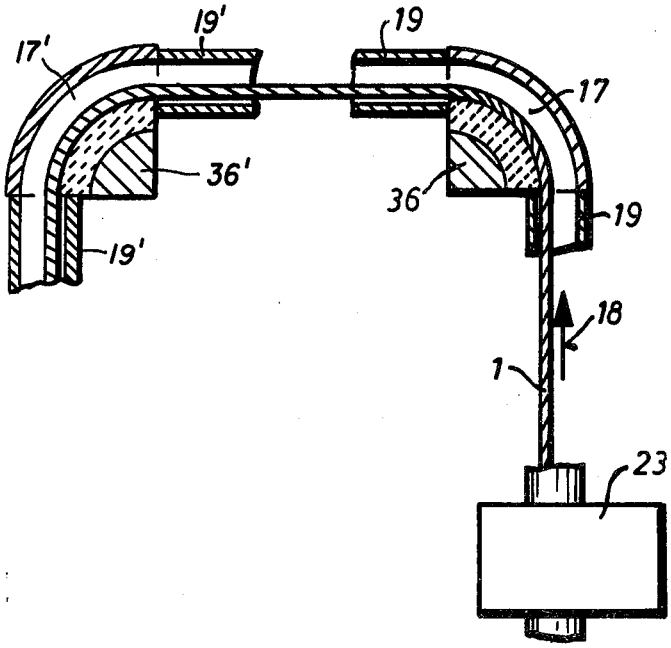
FIG. 5 is a sectional view taken along the line V-V of FIG. 4 and further showing a lubricant container.

In FIGS. 4 and 5 there is illustrated a further structure for load relief of the wire. A slide guide 36 having a frame or support comprising a plurality of components has a V-shaped notch or groove 40 having a rounded bottom made of a material which has a low sliding friction with respect to the moving wire 1. The groove 40 is covered by a plate 16 so as to define a duct or passage 17 in which the wire 1 moves. The wire 1 moves in the direction of the arrow 18 and air is blown through the passage 17 in the direction of movement 18 of the wire. The air thus assists in conveying the wire upon the slide guide contact path. Tubular extensions 19 and 19' may be attached such as by bolting to the ends of the passage 17 and may extend to a passage 17' on a next slide guide 36' and to the source of air under pressure so that a single passage for air is formed and air is thus introduced only at the inlet of the pipe formed from these extensions 19.

As shown in FIG. 5, the wire 1 is passed through a container 23 having a suitable lubricant therein. The lubricant may also be introduced with the compressed air being admitted into the inlet of the pipe extension 19.

Figure 6:
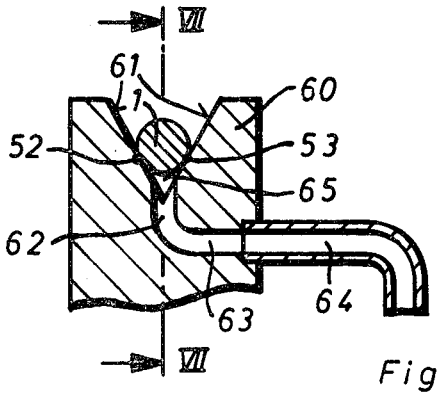
FIG. 6 is a view similar to that of FIG. 4 and showing still a further modification.
Figure 7:
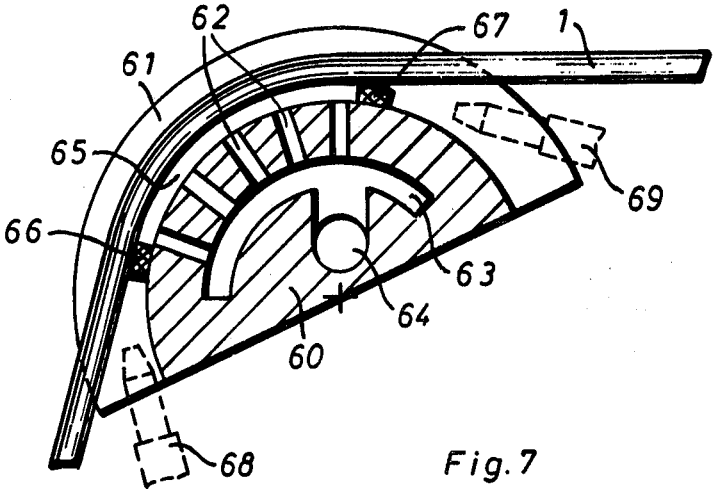
FIG. 7 is a sectional view taken along the line VII-VII of FIG. 6.

In FIGS. 6 and 7, there is shown a further structure of a slide guide for removing the load from the wire. This structure may be employed not only during the starting and completion of a winding operation but also during the entire winding operation. A slide guide 60 is provided with a V-shaped groove 61 whose flanks extend at such an angle that the wire 1 moving through the groove contacts both flanks of the groove to provide a double linear contact of the wire along lines 52 and 53. Opening into the groove 61 is a plurality of radially extending ducts 62 which are connected through a main-duct 63 to a pipe 64 which in turn is connected to a source of compressed air. A space or chamber 65 is thus formed between the bottom of notch 61 and the wire 1 and compressed air is introduced into this space 65 through the pipe 64. The air thus tends to lift the wire 1 from its contact with the flanks of groove 61 to effect a significant degree of load relief of the wire.

As may be seen in FIG. 7, blocks 66 and 67 are provided at the ends of the arc of contact of the wire 1 with the groove 61 so as to form a closed chamber together with the wire 1 and bottom of groove 61. The blocks 66 and 67 thus prevent the escape of air from the chamber 65 or at least reduce the escape of air to a minimum so as to permit a buildup of pressure of air in the chamber 65 so as to lift the wire from contact with the flanks of groove 61.

In place of the blocks 66 and 67 compressed-air nozzles 68 and 69 may be provided at both ends of the arc of contact of wire 1 so as to blow air into the ends of chamber 65 to achieve the effect of building up pressure in the groove to lift the wire from contact therewith.

The blocks 66 and 67 are preferably made of a wear-resistant material such as that of the material 42 in the slide guide shown in FIG. 3 or may be a flame hardened high-grade alloy steel or a tungsten-carbide which may be subjected to a plasma process under high frequency.

Upon the introduction of air into the chamber 65 through the duct 62 and through the nozzles 68, 69, the wire sliding over the guide is supported upon the air. The supporting of the wire by the air thus removes the load from the wire at the start-up and completion speeds encountered in the course of a winding operation. It is also possible to provide such load relief for the wire during continuous operation and thus this air support of the wire can be provided during the entire winding operation including the start and completion thereof.

An air cushion is readily formed below the wire when the wire contacts both flanks of the V-shaped groove. Introducing compressed air from nozzles into both ends of the arc of contact of the wire with the groove counter-acts the outflow of air from both ends of the chamber 65 formed under the wire.

The air which is supplied to form the cushion may be enriched with a lubricant or, in place of the air, a lubricating fluid may be introduced under pressure into the space between the wire and the bottom of the groove. Where the wire is run through a coolant such as water upon being withdrawn from the wire-drawing machine, the cooling water may also be provided with a lubricant to facilitate sliding of the wire over the slide guides.

The modification of FIG. 8 is particularly adapted for winding operations involving thin wire. The wire 1 is introduced into a conical flyer 71 along the axis of rotation thereof into a closed guide duct comprising a pipe 70 of small cross section and formed of a wear-resistant material at least at its bends. The pipe 70 is shaped as shown in FIG. 8 and is provided with an outlet from which the wire 1 exits to be wound around a spool 28. A seal or packing 74 is provided in the shaft 5 and air under pressure is introduced into the pipe 70 which then flows through the pipe and assists in conveying the wire through the pipe. The air escapes at outlet 72 of the pipe and is particularly advantageous during the acceleration or braking of the flyer during starting and finishing phases of the winding operation. The air flowing through pipe 70 functions in a manner similar to that of the air flowing through the duct 17 in the slide guide of FIGS. 4 and 5. Thus, the compressed air blown through the pipe 70 removes the load from the wire during its passage through the guide duct formed by the pipe 70.

An affect similar to that of the pipe 70 can also be achieved by providing air-tight closed ducts on the slide guides and interconnecting said ducts by pipes between the individual guides. The transition between the pipes and the guides are sealed in order to prevent an undesirable escape of air therefrom.

Thus it can be seen that the present invention eliminates the disadvantage of stressing or loading of the wire which occurs during acceleration and braking of the flyer in the beginning and completion phases of the wire winding operation. According to the present invention, the arc of contact of the wire upon the slide guides is selected to obtain a suitable easy sliding of the wire upon the guides even during the starting and braking phases. The contact surfaces on the slide guides can be made of a material having a low coefficient friction or having a surface structure that produces low friction as the wire moves through the slide guide. There is also provided a closed duct on the guides through which the wire is guided and compressed air is forced through the duct in the direction of movement of the wire at least during the starting and braking phases of the winding operation. Friction of the wire upon the slide guide can be reduced by forming an air-cushion between the wire and the guide or by introducing a film of lubricant between the wire and the guide.

It will be understood that this invention is susceptible to modification in order to adapt it to different usages and conditions, and accordingly, it is desired to comprehend such modifications within this invention as may fall within the scope of appended claims.

What is claimed is:

1. An apparatus for winding at a high speed a strand such as wire and the like upon a spool comprising means for supporting therein a spool upon which a strand is to be wound, a rotatably mounted flyer movable around the spool to wind the strand therein, said flyer having outer wall means surrounding said spool, means for reciprocating said flyer relative to said spool, guide means within and fixed relative to said flyer for introducing a moving strand into the rotatable flyer along its axis of rotation, means mounted on the inner surface of the wall means of the flyer and spaced from the axis of rotation of the flyer for slidingly supporting and guiding the strand moving within the rotatable flyer from its introduction at the axis of rotation to a path substantially parallel to said axis, said slide support means having an arcuate groove therein to define a path for the wire, and means within said flyer for selectively adjusting the position of said slide support means relative to said flyer and along a generatrix of the flyer so that the arc of the strand along said path is variable.

2. A device for guiding and/or changing the direction of movement of a wire and the like moving at a high speed in a rotating structure, and comprising means fixed relative to said rotating structure for introducing a moving wire into the rotating structure along its axis of rotation, and means mounted on said rotating structure spaced from the axis of rotation of the rotating structure for slidingly supporting the wire moving within the rotating structure, said slide support means having a path thereon for the wire, and means within said rotating structure for selectively adjusting the position of said slide support means relative to said rotating structure along a generatrix of the rotating structure so that the arc of contact of the strand along said path is variable.

3. A device as claimed in claim 1 wherein the portion of said slide support means contacted by the moving wire comprises a ceramic element to define a wear-resistant surface.

4. A device as claimed in claim 1 and further comprising means on the portion of said slide support means contacted by the wire to define a low friction surface.

5. A device as claimed in claim 1 and further comprising a mount for said slide guide means of a low density material, said mount having portion thereof removed to define recesses.

6. A device as claimed in claim 1 wherein said slide support means has a path thereon contacted by the moving wire, said path comprising a highly wear-resistant material, and a frame supporting said slide support means comprising a plurality of components.

7. A device as claimed in claim 6 and comprising elastic elements interposed between said wear-resistant material of said path and supporting components of said frame.

8. A device as claimed in claim 1 and comprising means on said slide support means for defining a closed passage thereon through which said wire is moved, and means for introducing air under pressure into said passage means.

9. A device as claimed in claim 8 and comprising a second slide support means and closed passage means thereon, and a pipe interconnecting the closed passage means of said first and second slide support means.

10. A device as claimed in claim 1 and comprising means on said slide support means for defining a path thereon contacted by the moving wire, there being a plurality of openings along said contact path and said openings connected to a source of fluid under pressure.

11. A device as claimed in claim 10 wherein said contact path has angularly extending flanks at such an angle that a wire moving therethrough makes linear contact on both of said flanks.

12. A device as claimed in claim 11 and comprising a pair of blocks each at an end of said contact path below the wire therein to define a closed chamber with said wire along said contact path.

13. A device as claimed in claim 12 and comprising means for directing streams of air under pressure toward the portion of said contact path underneath the wire moving therethrough.

14. A device as claimed in claim 13 and comprising means on said slide support means for defining a path thereon contacted by the moving wire, there being a plurality of openings along said contact path and said openings being connected to a source of a lubricant.

* * * * *